US007436242B1

(12) United States Patent
Nosker

(10) Patent No.: US 7,436,242 B1
(45) Date of Patent: Oct. 14, 2008

(54) SYSTEM AND METHOD FOR PROVIDING AN INPUT VOLTAGE INVARIANT CURRENT SOURCE

(75) Inventor: Zachary Zehner Nosker, Sebastopol, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 151 days.

(21) Appl. No.: 11/035,331

(22) Filed: Jan. 13, 2005

(51) Int. Cl.
*G05F 1/10* (2006.01)

(52) U.S. Cl. ..... 327/538

(58) Field of Classification Search ..... None
See application file for complete search history.

(56) References Cited

U.S. PATENT DOCUMENTS 3,659,121 A * 4/1972 Frederiksen ..... 327/538
3,660,694 A * 5/1972 Lucas ..... 327/538
3,831,040 A * 8/1974 Nanba et al. ..... 327/512
4,270,081 A * 5/1981 Hareyama ..... 323/316
4,335,346 A * 6/1982 Streit ..... 323/313
4,461,992 A * 7/1984 Yamaguchi et al. ..... 323/313
4,833,344 A * 5/1989 Moon et al. ..... 327/540
5,164,658 A * 11/1992 Kuwahara ..... 323/315
5,608,348 A * 3/1997 Kearney et al. ..... 327/538
5,801,584 A * 9/1998 Mori ..... 327/543
5,883,546 A * 3/1999 Kaminishi et al. ..... 327/565
6,201,377 B1 * 3/2001 Sauer ..... 323/313
6,724,243 B2 * 4/2004 La Rosa ..... 327/543
6,906,579 B2 * 6/2005 Masleid et al. ..... 327/538
6,922,092 B2 * 7/2005 Stark et al. ..... 327/170
7,034,603 B2 * 4/2006 Brady et al. ..... 327/538
2003/0006827 A1 * 1/2003 Watanabe ..... 327/538

* cited by examiner

*Primary Examiner*—Tuan T Lam

(57) ABSTRACT

A system and method is disclosed for providing a current source that has an approximately constant value of output current over a range of supply voltages. The current source of the invention comprises a plurality of peaking current source circuits coupled in parallel. Each of the plurality of peaking current source circuits provides a separate output current for a given value of supply voltage. The separate output currents of the peaking current source circuits are added together to provide a total output current for a given value of supply voltage. The total output current remains approximately constant for each value of supply voltage within a range of supply voltages.

20 Claims, 4 Drawing Sheets

SYSTEM AND METHOD FOR PROVIDING AN INPUT VOLTAGE INVARIANT CURRENT SOURCE

TECHNICAL FIELD OF THE INVENTION

The present invention is generally directed to the manufacture of current sources for semiconductor circuits and, in particular, to a system and method for providing an input voltage invariant current source.

BACKGROUND OF THE INVENTION

Constant current sources are known in the semiconductor manufacturing industry. One well-known type of constant current source is known as a peaking current source circuit. However, prior art constant current sources do not provide a constant current over a wide range of supply voltages.

In a prior art constant current source, the value of the output current with respect to the supply voltage has a maximum or "peak" at a particular value of supply voltage. The values of output current that correspond to values of supply voltage that are greater than the particular value of supply voltage are less than the maximum or "peak" value of output current. Similarly, the values of output current that correspond to values of supply voltage that are less than the particular value of supply voltage are less than the maximum or "peak" value of output current.

Because the specifications required for many electronic circuits require a range of supply voltages, prior art constant current sources are not adequate to bias many types of electronic circuits.

Therefore, there is a need in the art for a system and method that is capable of providing a current source that has an approximately constant value of output current over a range of supply voltages.

SUMMARY OF THE INVENTION

To address the above-discussed deficiencies of the prior art, it is a primary object of the present invention to provide a system and method for providing a current source that has an approximately constant value of output current over a range of supply voltages.

In one advantageous embodiment, the current source of the invention comprises a plurality of peaking current source circuits coupled in parallel. Each of the plurality of peaking current source circuits provides a separate output current for a given value of supply voltage. The separate output currents of the peaking current source circuits are added together to provide a total output current for a given value of supply voltage. The total output current remains approximately constant for each value of supply voltage within a range of supply voltages.

The current source of the invention may be tuned to adjust the value of the total output current to a desired value. Similarly, the current source of the invention may also be tuned to adjust the value of the range of supply voltages over which the total output current has an approximately constant value.

It is an object of the present invention to provide a system and method for providing a current source that has an approximately constant value of output current over a range of supply voltages.

It is also an object of the present invention to provide a system and method for providing a current source that comprises a plurality of peaking current source circuits coupled in parallel.

It is yet another object of the present invention to provide a system and method for providing a current source that has an approximately constant value of output current over a range of supply voltages in which the value of total output current may be adjusted to a desired value.

It is another object of the present invention to provide a system and method for providing a current source that has an approximately constant value of output current over a range of supply voltages in which the range of supply voltages may be adjusted to a desired range of values.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art should appreciate that they may readily use the conception and the specific embodiment disclosed as a basis for modifying or designing other structures for carrying out the same purposes of the present invention. Those skilled in the art should also realize that such equivalent constructions do not depart from the spirit and scope of the invention in its broadest form.

Before undertaking the Detailed Description of the Invention below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior uses, as well as future uses, of such defined words and phrases.

BRIEF DESCRIPTION OF THE DRAWINGS

For a more complete understanding of the present invention and its advantages, reference is now made to the following description taken in conjunction with the accompanying drawings, in which like reference numerals represent like parts.

DETAILED DESCRIPTION OF THE INVENTION

Figure 1:
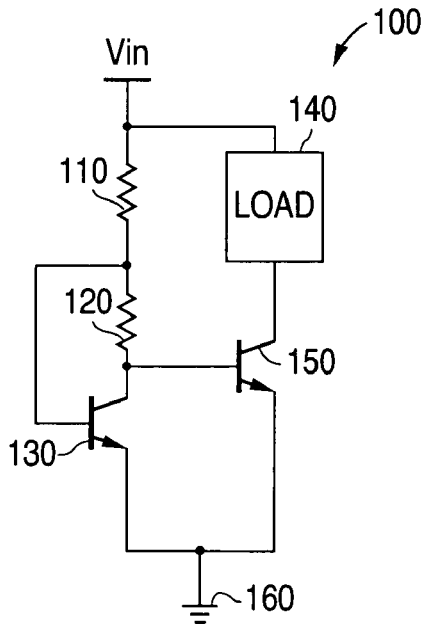
FIG. 1 (PRIOR ART)
FIG. 1 illustrates a schematic diagram of a prior art peaking current source circuit.

FIGS. 1 through 8 and the various embodiments used to describe the principles of the present invention in this patent document are by way of illustration only and should not be construed in any way to limit the scope of the invention. Those skilled in the art will understand that the principles of the present invention may be implemented in any type of suitably arranged circuitry for providing a current source.

To simplify the drawings the reference numerals from previous drawings will sometimes not be repeated for structures that have already been identified.

In order to better understand the principles of the present invention a description of an exemplary prior art peaking current source circuit will first be given. The exemplary prior art peaking current source circuit 100 shown in FIG. 1 comprises a first resistor 110, a second resistor 120, a first NPN transistor 130, a second NPN transistor 150, and a load 140.

As shown in FIG. 1, the base and collector of first NPN transistor 130 are connected together through second resistor 120. The base of first transistor 130 is connected to the supply voltage terminal $V_{in}$ through first resistor 110. The emitter of first NPN transistor is connected to ground 160.

The collector of first NPN transistor 130 is connected to the base of second NPN transistor 150. The emitter of second NPN transistor 150 is connected to ground 160. The collector of second NPN transistor 150 is connected to the supply terminal $V_{in}$ through a load circuit 140. The operation of the prior art peaking current source circuit 100 shown in FIG. 1 is described in U.S. Pat. No. 3,659,121 issued to Frederiksen.

Figure 2:
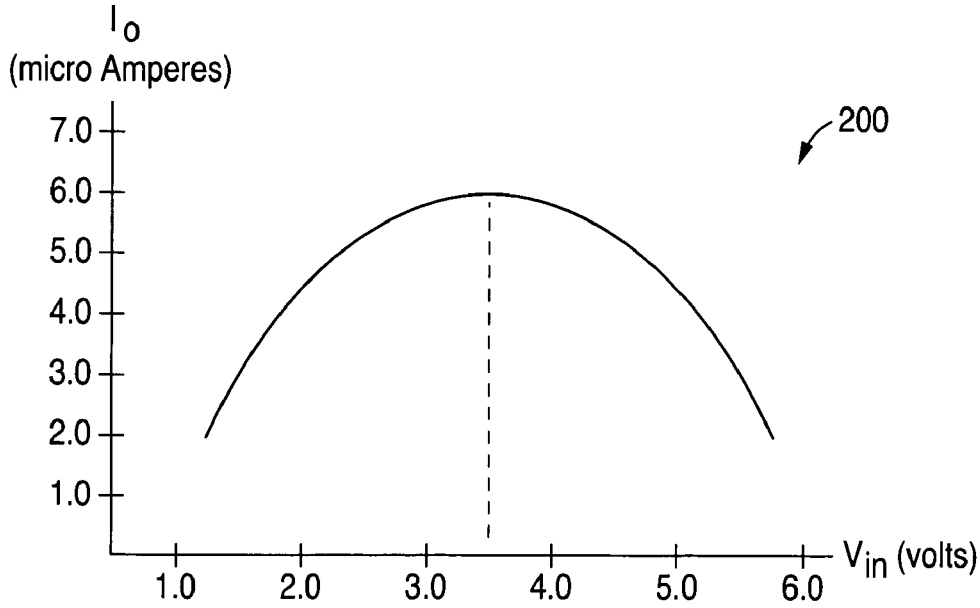
FIG. 2 illustrates a graph of output current versus supply voltage for a prior art peaking current source circuit.

FIG. 2 illustrates a graph of output current versus supply voltage 200 for a prior art peaking current source circuit. As shown in FIG. 2, the value of the output current ($I_o$) with respect to the supply voltage ($V_{in}$) has a maximum or "peak" that is equal to approximately six micro Amperes (6.0 μA) when the supply voltage is approximately three and five tenths volts (3.5 volts). The values of output current ($I_o$) that correspond to values of supply voltage ($V_{in}$) that are above the 3.5 volts value are less than the maximum or "peak" value of 6.0 μA. Similarly, the values of output current ($I_o$) that correspond to values of supply voltage ($V_{in}$) that are below the 3.5 volts value are less than the maximum or 'peak" value of 6.0 μA. Because the specifications required for many electronic circuits require a range of input voltages, prior art current sources are not adequate to bias many types of electronic circuits.

Figure 3:
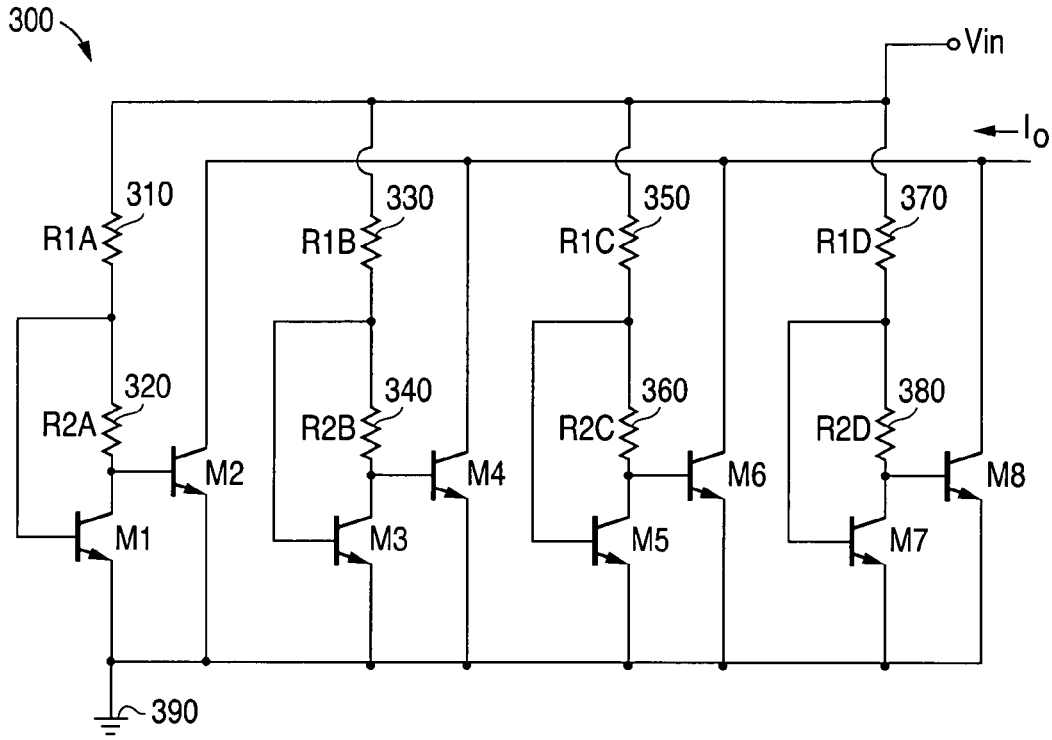
FIG. 3 illustrates an advantageous embodiment of a current source circuit constructed in accordance with the principles of the present invention.

To remedy the deficiencies of the prior art, the present invention comprises an improved system and method that provides a relatively constant current over an extended range of values of input voltages. FIG. 3 illustrates an advantageous embodiment of a current source circuit 300 in accordance with the principles of the present invention. Current source circuit 300 comprises a plurality of peaking current source circuits coupled in parallel.

In the exemplary embodiment shown in FIG. 3 the number of peaking current source circuits is four. It is understood that the number of peaking current source circuits in the invention is not limited to four. There may be more than four or fewer than four peaking current source circuits. The number four is simply used in the illustrative example shown in FIG. 3.

The current source circuit 300 shown in FIG. 3 provides a combined current at the output that is approximately constant over a range of supply voltages. The magnitude of the output current and the input voltage range can be adjusted to fit specific design requirements by tuning the individual peaking current source circuits. The individual peaking current source circuits may be tuned, for example, by changing the values of resistance of the resistors within each of the individual peaking current source circuits.

The first peaking current source circuit (referred to as the first stage) in current source circuit 300 is composed of first resistor 310 (designated with the reference letters R1A), second resistor 320 (designated with the reference letters R2A), first transistor M1, and second transistor M2. The transistors M1 and M2 are NPN transistors.

The base and collector of first transistor M1 are connected together through second resistor 320. The base of first transistor M1 is connected to the supply voltage terminal $V_{in}$ through first resistor 310. The emitter of first transistor M1 is connected to ground 390.

The collector of first transistor M1 is connected to the base of second transistor M2. The emitter of second transistor M2 is connected to ground 390. The collector of second transistor M2 is connected to the output current terminal $I_o$.

The second peaking current source circuit (referred to as the second stage) in current source circuit 300 is composed of third resistor 330 (designated with the reference letters R1B), fourth resistor 340 (designated with the reference letters R2B), third transistor M3, and fourth transistor M4. The transistors M3 and M4 are NPN transistors.

The base and collector of third transistor M3 are connected together through fourth resistor 340. The base of third transistor M3 is connected to the supply voltage terminal $V_{in}$ through third resistor 330. The emitter of third transistor M3 is connected to ground 390.

The collector of third transistor M3 is connected to the base of fourth transistor M4. The emitter of fourth transistor M4 is connected to ground 390. The collector of fourth transistor M4 is connected to the output current terminal $I_o$.

The third peaking current source circuit (referred to as the third stage) in current source circuit 300 is composed of fifth resistor 350 (designated with the reference letters R1C), sixth resistor 360 (designated with the reference letters R2C), fifth transistor M5, and sixth transistor M6. The transistors M5 and M6 are NPN transistors.

The base and collector of fifth transistor M5 are connected together through sixth resistor 360. The base of fifth transistor M5 is connected to the supply voltage terminal $V_{in}$ through fifth resistor 350. The emitter of fifth transistor M3 is connected to ground 390.

The collector of fifth transistor M5 is connected to the base of sixth transistor M6. The emitter of sixth transistor M6 is connected to ground 390. The collector of sixth transistor M6 is connected to the output current terminal $I_o$.

Lastly, the fourth peaking current source circuit (referred to as the fourth stage) in current source circuit 300 is composed of seventh resistor 370 (designated with the reference letters R1D), eighth resistor 380 (designated with the reference letters R2D), seventh translator M7, and eighth transistor M8. The transistors M7 and M8 are NPN transistors.

The base and collection of seventh transistor M7 are connected together through eighth resistor 380. The base of seventh transistor M7 is connected to the supply voltage terminal $V_{in}$ through seventh resistor 370. The emitter of seventh transistor M7 is connected to ground 390.

The collector of seventh transistor M7 is connected to the base of eighth transistor M8. The emitter of eighth transistor M8 is connected to ground 390. The collector of eighth transistor M8 is connected to the output current terminal $I_o$.

Figure 4:
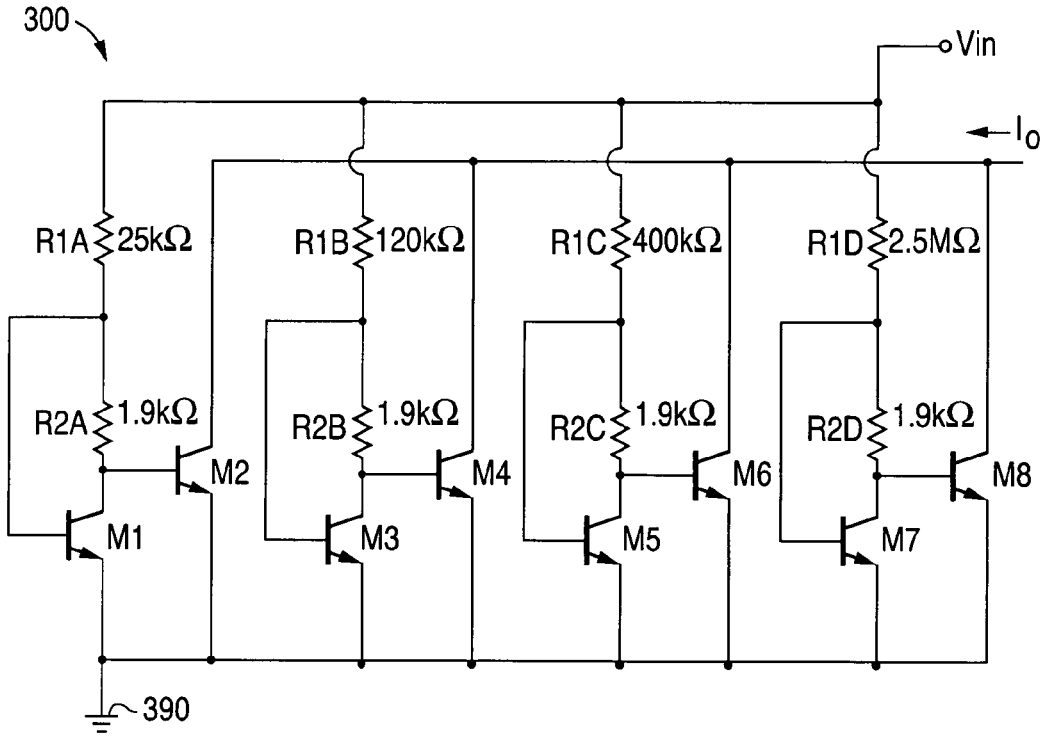
FIG. 4 illustrates the current source circuit shown in FIG. 3 having an exemplary set of resistor values.

A numerical example will be given in order to better explain the operation of current source circuit 300. FIG. 4 illustrates the current source circuit 300 shown in FIG. 3 in which the resistors are assigned numerical values. Specifically, the second resistor 320 (R2A), and the fourth resistor 340 (R2B), and the sixth resistor 360 (R2C), and the eighth resistor 380 (R2D) are each assigned a value of resistance of one and nine tenth kilohms (1.9 kΩ)

The first resistor 310 (R1A) is assigned a value of resistance of twenty five kilohms (25 kΩ). The third resistor 330 (R1B) is assigned a value of resistance of one hundred twenty kilohms (120 kΩ). The fifth resistor 350 (R1C) is assigned a value of resistance of four hundred kilohms (400 kΩ). The seventh resistor 370 (R1D) is assigned a value of resistance of two and five tenth million ohms (2.5 MΩ).

With these values of resistance, the current source circuit 300 produces an output current $I_o$ of approximately ten microamperes (10.0 μA) over a range of supply voltage $V_{in}$ from approximately one volt (1.0 volt) to approximately six volts (6.0 volts).

Each of the four stages has a nominal current of five microamperes (5.0 μA). Circuit analysis provides the following expression for a value of $R_2$:

$$R_2 = \frac{(V_T)}{(e)(I_{C2})} \tag{1}$$

where "e" is the base of natural logarithms. Therefore, $$R_2 = \frac{(25.85\ \text{mV})}{(2.718)(5\times10^{-6}A)} = 1.9\ k\Omega \tag{2}$$

Circuit analysis also provides the following expression for a value of $R_1$:

$$R_1 = \frac{(V_{CC} - V_{BE1})}{(e)(I_{C2})} \tag{3}$$

Rearranging Equation (3) and using $V_{CC}=V_{PEAK}$ and $I_{C2}=I_o$ gives the equation:

$$V_{PEAK}=e\,R_1 I_o+V_{BE1} \tag{4}$$

Using 2.71828 for the value of "e" (the base of natural logarithms), and using $I_o$=5.0 μA, and using $V_{BE1}$=0.65 volt, the output current peaks as follows for each of the four stages:

| $R_1$ Value | Peak Location |
|---|---|
| 25 kΩ | 1.0 volt |
| 120 kΩ | 2.28 volts |
| 400 kΩ | 6.09 volts |
| 2.5 MΩ | 34.63 volts |

Figure 5:
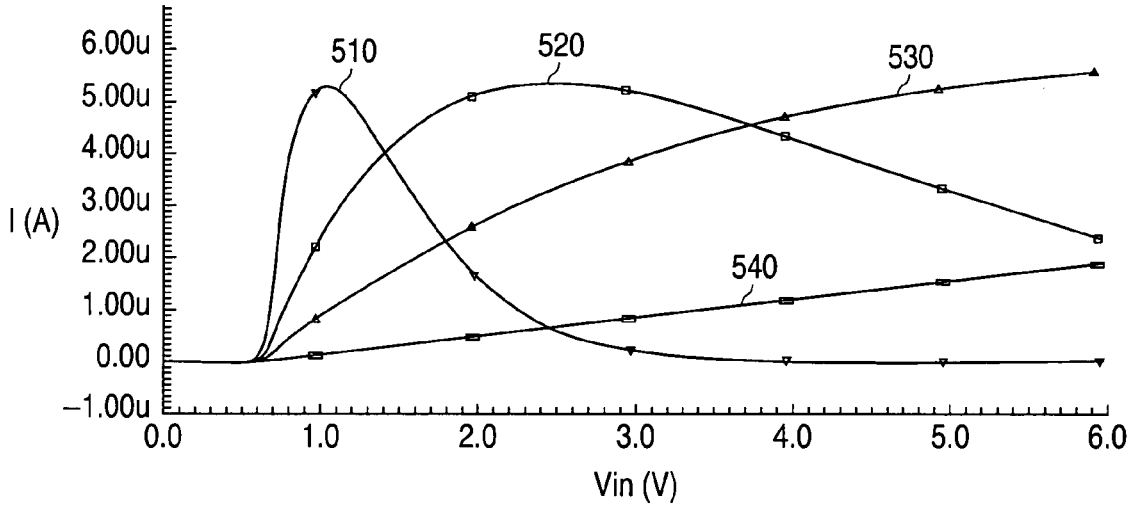
FIG. 5 illustrates a graph of output current versus supply voltage for each of the four stages of the current source circuit shown in FIG. 4.

FIG. 5 illustrates a graph of output current versus supply voltage for each of the four stages of the current source circuit 300 shown in FIG. 4. As shown in FIG. 5, the output current 510 for the first stage (having a value of resistance of 25 kΩ for $R_1$) peaks at approximately one volt (1.0 volt). The output current 520 for the second stage (having a value of resistance of 120 kΩ for $R_1$) peaks at approximately two and twenty eight hundredths volts (2.28 volts). The output current 530 for the third stage (having a value of resistance of 400 kΩ for $R_1$) peaks at approximately six and nine hundredths volts (6.09 volts). The output current 540 for the fourth stage (having a value of resistance of 2.5 MΩ for $R_1$) peaks at approximately thirty four and sixth three hundredths volts (34.63 volts). The peak of the output current for the fourth stage is located off the scale of the graph shown in FIG. 5.

As will be described more fully below, the sum of the output current of the four stages is an output current that is approximately ten microamperes (10 μA). The total output current of ten microamperes (10 μA) remains substantially constant as the value of the supply voltage varies from one volt (1.0 volt) to six volts (6.0 volts).

Figure 6:
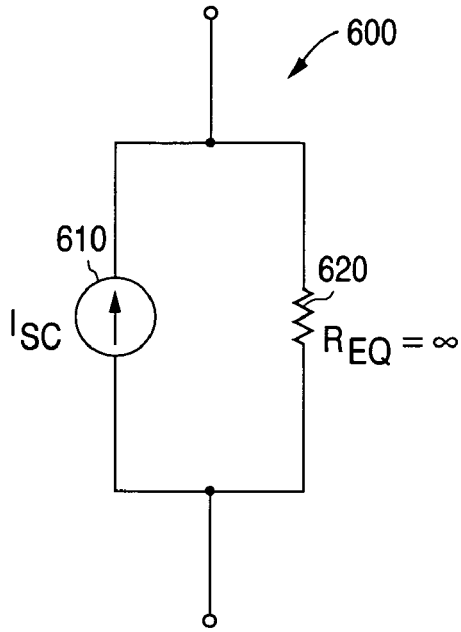
FIG. 6 (PRIOR ART)
FIG. 6 illustrates a schematic diagram of a model of an ideal current source in parallel with an infinite resistance.

FIG. 6 illustrates a schematic diagram of a model of an ideal current source 610 (designated $I_{SC}$) in parallel with an infinite resistance 620 (designated $R_{EQ}$). With respect to modeling the four peaking current source stages of current source circuit 300, the impedance of each stage, while not infinite, will be very large. This is because the impedance that is seen when looking into the collector of a bipolar junction transistor (BJT) is:

$$R_C=r_o=V_A/I_C$$

In the case of one peaking current source stage the output resistance $R_o$ is approximately :

$$R_O \cong \frac{(100\ V)}{(5\times10^{-6}A)} = 20\ M\Omega$$

Therefore, while the output impedance of each stage is not infinite, it is still quite large. By placing four of the stages in parallel, the output resistance is decreased by a factor of four. This resulting 5 MΩ is still a large output resistance.

$$R_O \cong \frac{20\ M\Omega}{4} = 5\ M\Omega$$

Figure 7:
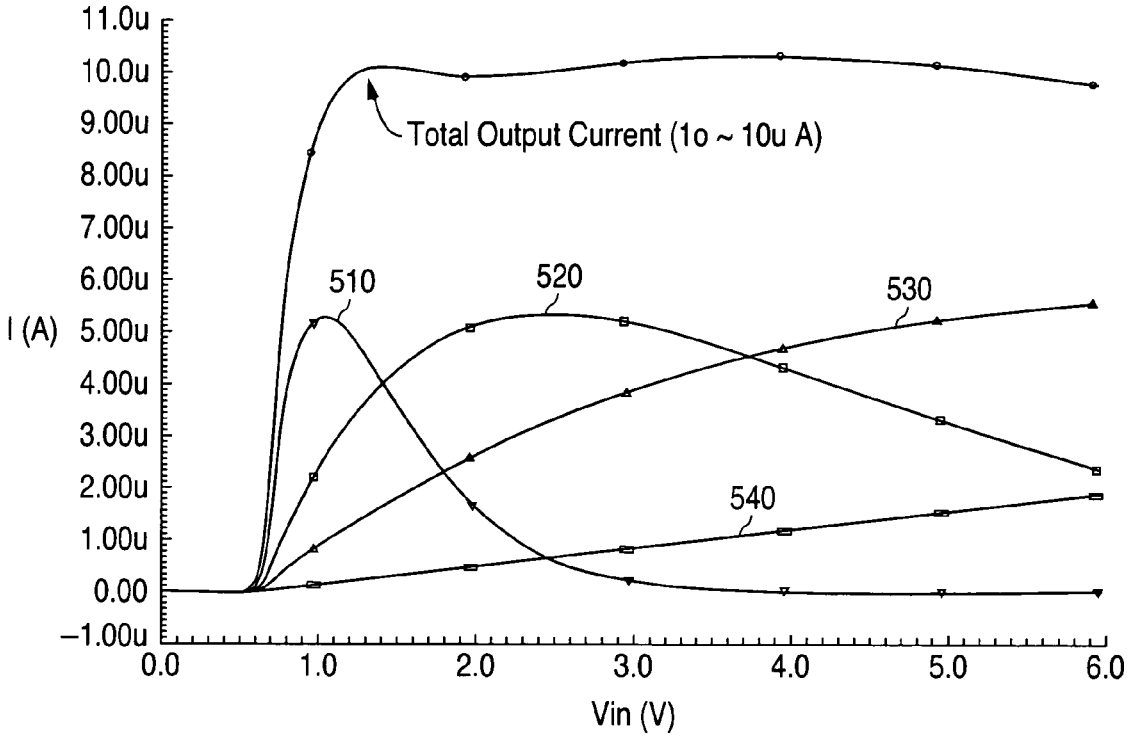
FIG. 7 illustrates a graph of output current versus supply voltage showing the total output current of the four stages of the current source circuit shown in FIG. 4.

FIG. 7 illustrates a graph of output current versus supply voltage showing the total output current ($I_o$) of the four stages of the current source circuit 300 shown in FIG. 4. FIG. 7 also includes the individual contributions to the output current from each of the four separate stages of current source circuit 300.

The values of the total output current ($I_o$) are very close to the value of ten microamperes (10 μA). The values of total output current ($I_o$) as a function of supply voltage ($V_{in}$) set forth in the table below were observed in the simulated operation of current source circuit 300. The values of the total output current ($I_o$) in the table represent peaks and troughs in the total output current ($I_o$).

| $V_{in}$ Value | $I_o$ Value |
|---|---|
| 1.45 volts | 10.09 μA |
| 2.10 volts | 9.92 μA |
| 3.80 volts | 10.33 μA |
| 6.00 volts | 9.75 μA |

Figure 8:
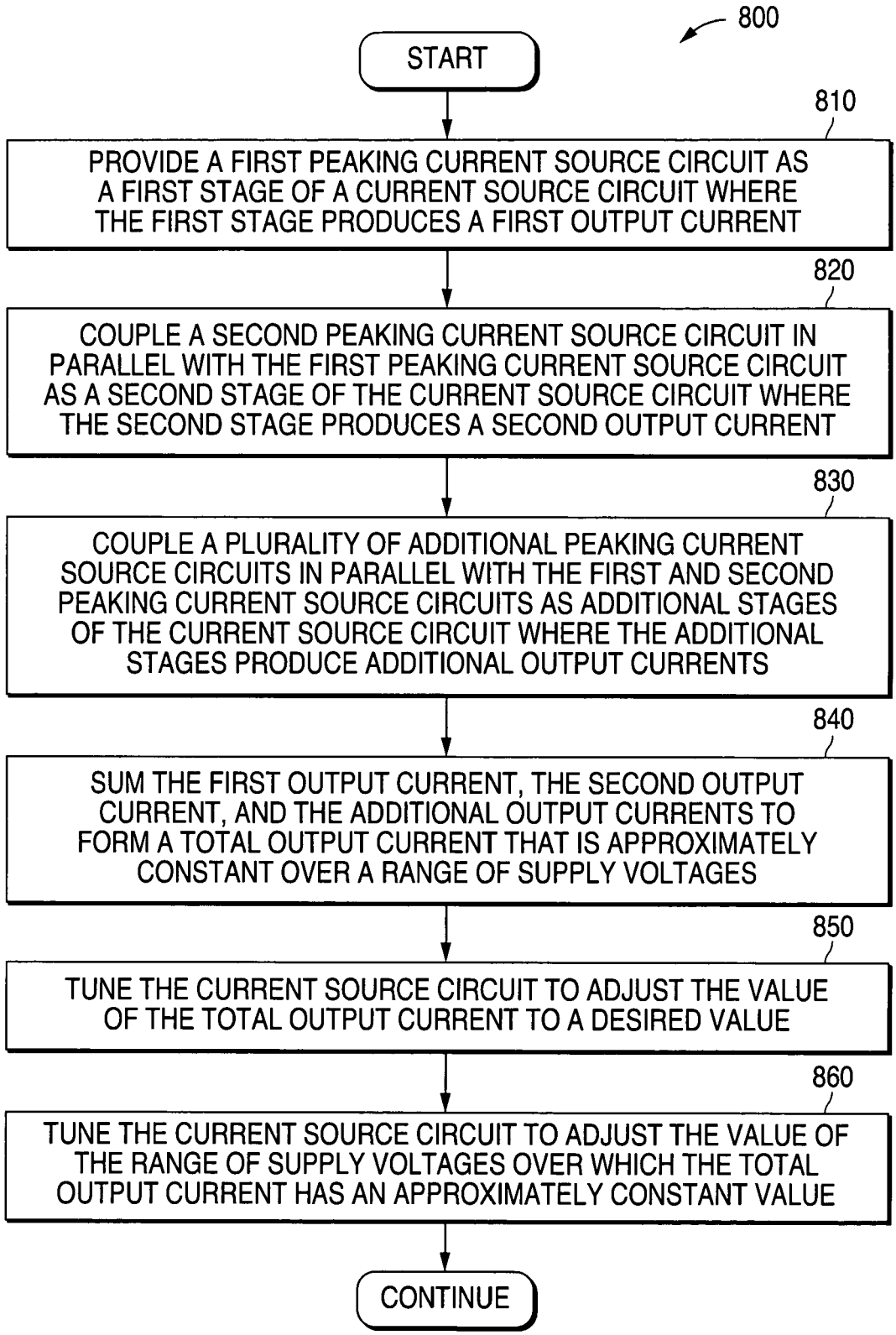
FIG. 8 illustrates a flow chart showing the steps of an advantageous embodiment of the method of the present invention.

FIG. 8 illustrates a flow chart showing the steps of an advantageous embodiment of the method of the present invention. A first peaking current source circuit is provided as a first stage of a current source circuit 300. The first stage produces a first output current 510 (Step 810). Then a second peaking current source circuit is coupled in parallel with the first peaking current source circuit. The second peaking current source circuit forms a second stage of the current source circuit 300. The second stage produces a second output current 520 (step 820).

Then a plurality of additional peaking current source circuits are coupled in parallel to the first and second peaking current source circuits. The plurality of additional peaking current source circuits form additional stages of the current source circuit 300. The additional stages produce additional output currents (e.g., output current 530), output current 540) (step 830).

The first output current 510, the second output current 520, and the additional output currents, 530 and 540, are added together to form the total output current ($I_o$) of the current source circuit 300. The total output current ($I_o$) is approximately constant over a range of supply voltages (step 840).

The current source circuit 300 may be tuned to adjust the value of the total output current ($I_o$) to a desired value (step 850). The current source circuit 300 may also be tuned to adjust the value of the range of supply voltages ($V_{in}$) over which the total output current ($I_o$) has an approximately constant value (step 850). While the number of additional stages in this example brings the number of stages to four, it is understood that the present invention is not limited to four stages.

The current source circuit 300 of the present invention supplies a current that has an approximately constant value of current over a range of supply voltages. Each stage of the current source circuit 300 is capable of being individually tuned for peak current value and peak location (with respect to the supply voltage). The current source circuit 300 of the present invention is also capable of producing fairly large currents at small input voltages.

Although the present invention has been described with an exemplary embodiment, various changes and modifications may be suggested to one skilled in the art. It is intended that the present invention encompass such changes and modifications as fall within the scope of the appended claims.

What is claimed is:

1. A method comprising the steps of:

providing a first bipolar transistor peaking current source circuit; and coupling in parallel to the first bipolar transistor peaking current source circuit at least one additional bipolar transistor peaking current source circuit, wherein the bipolar transistor peaking current source circuits are configured to provide peak output currents at different supply voltages, and wherein the bipolar transistor peaking current source circuits are configured to collectively provide a total output current that is approximately constant over a range of supply voltages.

2. The method as set forth in claim 1, wherein:

each of the bipolar transistor peaking current source circuits comprises a first resistor, a second resistor, a first bipolar transistor having a base and a collector connected together through the second resistor, and a second bipolar transistor; and at least some of the first and second resistors in the bipolar transistor peaking current source circuits have different resistances, the different resistances causing the bipolar transistor peaking current source circuits to provide the peak output currents at the different supply voltages.

3. The method as set forth in claim 1 further comprising the step of:

adjusting a value of said total output current to a desired value.

4. The method as set forth in claim 3 wherein said step of adjusting said value of said total output current to a desired value comprises the step of tuning one of:

said first bipolar transistor peaking current source circuit and said at least one additional bipolar transistor peaking current source circuit.

5. The method as set forth in claim 1 further comprising the step of:

adjusting a value of said range of supply voltages over which said total output current is approximately constant.

6. The method as set forth in claim 5 wherein said step of adjusting said value of said range of supply voltages comprises the step of tuning one of:

said first bipolar transmitter peaking current source circuit and said at least one additional bipolar transistor peaking current source circuit.

7. A method comprising:

coupling together in parallel a plurality of bipolar transistor peaking current source circuits, wherein each of the bipolar transistor peaking current source circuits comprises a first resistor, a second resistor, a first bipolar transistor having a base and a collector connected together through the second resistor, and a second bipolar transistor, wherein the bipolar transistor peaking current source circuits are configured to provide peak output currents at different supply voltages, and wherein the bipolar transistor peaking current source circuits form a current source configured to provide an approximately constant output current over a range of supply voltages.

8. The method as set forth in claim 7 further comprising the step of:

adding together an output current from each of said bipolar transistor peaking current source circuits to form a total output current that is approximately constant over said range of supply voltages.

9. The method to set forth in claim 8 further comprising the step of:

adjusting a value of said total output current to a desired value.

10. The method as set forth in claim 9 wherein said step of adjusting said value of said total output current to a desired value comprises the step of:

tuning at least one of said plurality of said bipolar transistor peaking current source circuits.

11. The method as set forth in claim 8 further comprising the step of:

adjusting a value of said range of supply voltages over which said total output current is approximately constant.

12. The method as set forth in claim 11 wherein said step of adjusting said value of said range of supply voltages comprises the step of:

tuning at least one of said plurality of said bipolar transistor peaking current source circuits.

13. An apparatus comprising:

a plurality of bipolar transistor peaking current source circuits coupled in parallel, wherein the bipolar transistor peaking current source circuits are configured to provide peak output currents at different supply voltages, and wherein the bipolar transistor peaking current source circuits are configured to collectively provide an approximately constant output current over a range of supply voltages.

14. The apparatus as set forth in claim 13 wherein each of the bipolar transistor peaking current source circuits comprises a first resistor, a second resistor, a first bipolar transistor, and a second bipolar transistor;

wherein a base and a collector of the first bipolar transistor are connected together through the second resistor;

wherein the base of said first bipolar transistor is connected to a supply voltage terminal through said first resistor, and wherein an emitter of said first bipolar transistor is connected to ground; and wherein the collector of said first bipolar transistor is connected to a base of said second bipolar transistor, and wherein an emitter of said second bipolar transistor is connected to ground, and wherein a collector of said second bipolar transistor is connected to an output current terminal.

15. The apparatus as set forth in claim 14 wherein said second resistor in each of said plurality of bipolar transistor peaking current source circuits has a value of resistance that is identical to the value of resistance of said other second resistors.

16. The apparatus as set forth in claim 13 wherein said first resistor in each of said plurality of bipolar transistor peaking current source circuits has a value of resistance that is different than the values of resistance of said other first resistors.

17. The apparatus as set forth in claim 13 wherein each of said plurality of bipolar transistor peaking current source circuits coupled in parallel provides an output current for a given value of supply voltage that when added to output currents from other bipolar transistor peaking current source circuits of said plurality of bipolar transistor peaking current source circuits gives a total output current for said given value of supply voltage.

18. The apparatus as set forth in claim 17 wherein said total output current for said given value of supply voltage remains approximately constant for each supply voltage within the range of supply voltage.

19. The apparatus as set forth in claim 18 wherein said apparatus adjusts said total output current to a desired value.

20. The apparatus as set forth in claim 18 wherein said apparatus adjusts said range of supply voltages over which said total output current has an approximately constant value.

* * * * *

UNITED STATES PATENT AND TRADEMARK OFFICE

CERTIFICATE OF CORRECTION

PATENT NO. : 7,436,242 B1
APPLICATION NO. : 11/035331
DATED : October 14, 2008
INVENTOR(S) : Zachary Zehner Nosker It is certified that error appears in the above-identified patent and that said Letters Patent is hereby corrected as shown below:

Column 10, line 4, claim 16, delete “claim 13” and replace with --claim 15--; and Column 10, line 19, claim 18, delete “voltage” and replace with --voltages--.

Signed and Sealed this

Thirtieth Day of December, 2008

JON W. DUDAS
*Director of the United States Patent and Trademark Office*